US005393280A

United States Patent [19]

Haviv

[11] Patent Number: 5,393,280

[45] Date of Patent: Feb. 28, 1995

[54] SWIMMING EXERCISE AND TRAINING APPARATUS

[76] Inventor: Joseph Haviv, 26 Braeswood Sq., Houston, Tex. 77096

[21] Appl. No.: 94,439

[22] Filed: Jul. 21, 1993

[51] Int. Cl.[6] ..... A63B 69/10

[52] U.S. Cl. ..... 482/56; 482/117

[58] Field of Search ..... 482/55, 56, 114–119, 482/142–145; 434/284

[56] References Cited

U.S. PATENT DOCUMENTS

| | | | |
|---|---|---|---|
| 1,176,365 | 3/1916 | Hartnett | 482/56 |
| 1,966,448 | 7/1934 | Kabisius | 482/56 |
| 1,990,124 | 2/1934 | Kabisius | 482/56 |
| 2,109,775 | 3/1938 | Hudson | 482/56 |
| 2,497,391 | 2/1950 | Becker | 482/56 |
| 3,112,928 | 12/1963 | Oswald | 482/55 |
| 3,782,721 | 1/1974 | Passera | 482/117 |
| 3,791,646 | 2/1974 | Marchignoni | 482/56 |
| 4,674,740 | 6/1987 | Iams et al. | 482/56 |
| 4,830,363 | 5/1989 | Kennedy | 482/56 |
| 5,158,513 | 10/1992 | Reeves | 482/56 |

FOREIGN PATENT DOCUMENTS 8601420 3/1986 WIPO ..... 482/56

*Primary Examiner*—Richard J. Apley
*Assistant Examiner*—John Mulcahy

[57] ABSTRACT

The swimming and training apparatus comprises:

a base disposed on a supporting surface for the apparatus, an upper body support arrangement secured to the base frame having a generally horizontal position capable of side to side rolling motion along its longitudinal axis and up and down tilt along its latitudinal axis at the point of attachment to the frame base, levers secured to the upper body support arrangement on both sides of the upper body support at the forward section in a manner to receive the users hands and arms and capable of simulating different swimming stroke styles, a head support attached to the fore section of the upper body support, levers secured to the aft section of the upper body support arrangement capable of receiving the users legs and by moving the legs simulating swimming leg kicks.

9 Claims, 5 Drawing Sheets

SWIMMING EXERCISE AND TRAINING APPARATUS

BACKGROUND OF INVENTION

The present invention relates to exercise apparatus and more particularly relates to an improved swimming exercise and training apparatus which can provide a strength and endurance workout while simulating movement of a person swimming in water.

Sports trainers and sport physiologists agree that performing an actual exercise is the most beneficial way to train and exercise.

Swimming is one of the most efficient forms of exercise since it involves almost all the body muscle groups and is one of the safest forms of exercise as it creates the least impact on the body.

Swimming exercises also provide a highly aerobic and cardiovascular regime to a person while minimizing risk of injuries that are more common in other forms of exercises like running or jumping or weight lifting.

Swimming exercise and training apparatus are described in prior art as represented in U.S. Pat. No. 5,158,513 issued on October 1992 to Mitchell P. Reeves and U.S. Pat. No. 4,830,363 issued on May 1989 to Robert J. Kennedy and various U.S. patents refered to in these patents.

The prior art swimming and training apparatus enable the user to approximate the kick movement of the legs and the stroke movement of the arms and the side to side roll of the body however, they fail to provide an arrangement that would enable the user to at least approximate the dolphin like motion of the body that occurs during the butterfly stroke swimming style.

Also the leg motion is limited to a straight up and down vertical plane. The present invention object is to provide an improved swimming and training apparatus enabling the user to simulate the dolphin like motion, the side to side rolling motion, and the movement of the legs in several directions with correspondence to the roll of the body.

The present invention also provides means to adjust the resistance of each lever independently and also provide resistance throughout the whole motion.

SUMMARY OF THE INVENTION

In accordance with the present invention there is provided a swimming exercise and training apparatus.

An object of the present invention is to provide an improved swimming and training apparatus.

Another object of the present invention is to provide an improved swimming exercise and training apparatus enabling the user to approximate the tilt movement simulating the dolphin motion used in the butterfly swimming style.

Another object of the present invention is to provide an improved swimming exercise and training apparatus enabling the user to simulate leg kicks as they would occur in the water in several directions in correspondence to the roll of the upper part of the body.

Another object of the present invention is to provide an improved swimming exercise and training apparatus enabling the user to adjust the tension of each lever independently.

Another object of the present invention is to provide an improved swimming exercise and training apparatus enabling the user to benefit from the tension resistance throughout the full motion of the levers without losing the resistance on the return of the arm strokes and leg kicks motion.

BRIEF DESCRIPTION OF THE DRAWINGS

These and other objects and advantages of the present invention will become more apparent upon reading the following detailed description and upon referring to the accompanying drawing in which.

Figure 1:
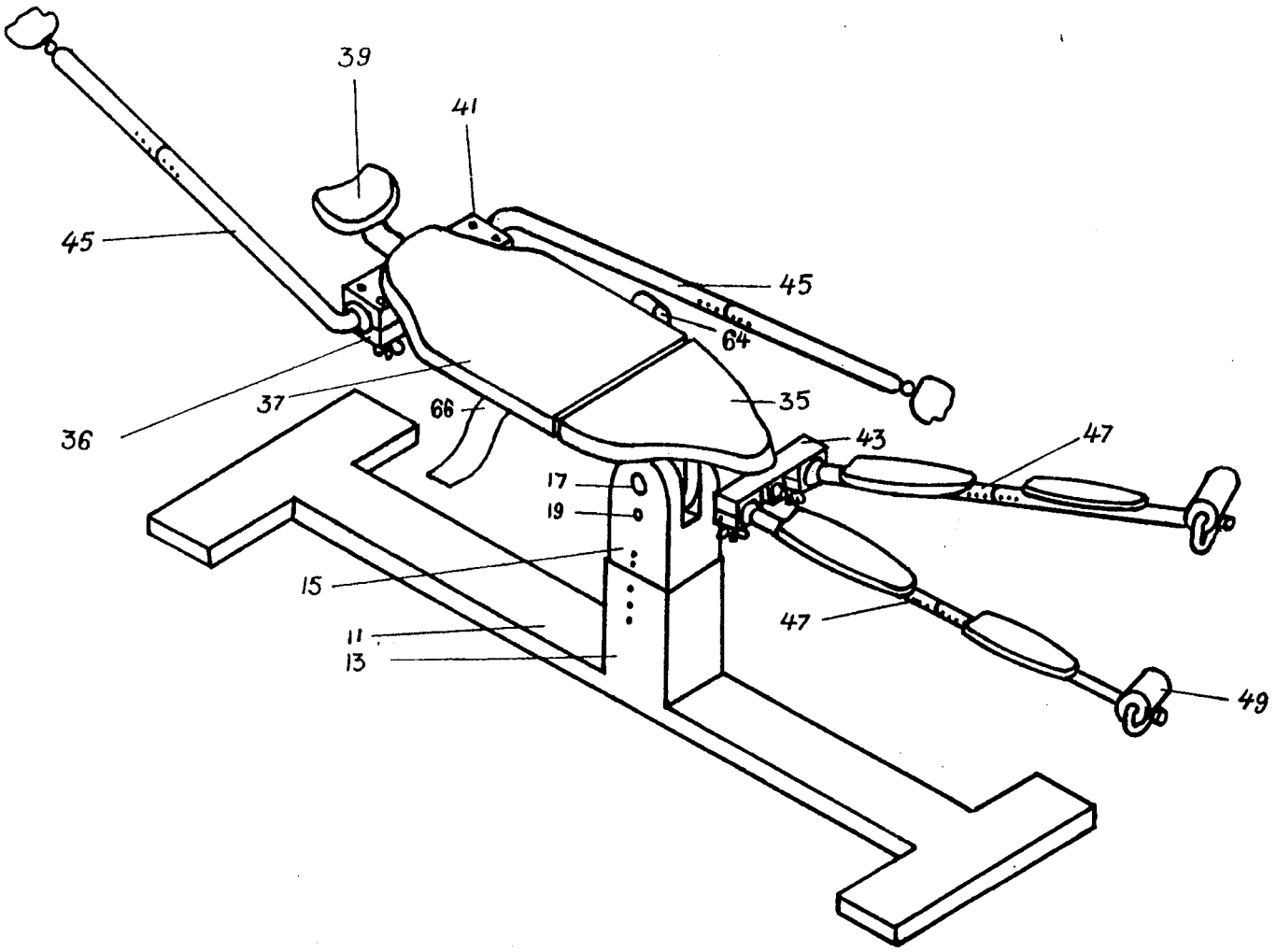
FIG. 1 is a perspective view of a swimming exercise and training apparatus in accordance with the present invention.

| PARTS REFERENCE NUMERALS | |
|---|---|
| 11. base. | 41. fore attachment bar. |
| 13. support sleeve. | 43. aft attachment bar |
| 15. support insert. | 45. arm lever assembly. |
| 17. connecting tilt pin. | 450. hand grip. |
| 19. tilt stopping pin. | 451. ball joint. |
| 21. connecting tilt plate | 452. arm lever fore section. |
| 23. roll shaft aft section. | 453. arm lever aft section. |
| 25. roll stopping pin. | 47. legs lever assembly. |
| 27. roll shaft fore section. | 471. leg lever fore section. |
| 29. body support attachment aft plate. | 472. leg lever aft section. |
| 31. body support attachment fore plate. | 473. thigh support pad. |
| 33. horizontal support sleeve. | 474. calf support pad. |
| 35. waist support pad. | 49. leg roll cushion. |
| 37. chest support pad. | 64. right strap. |
| 39. head support. | 66. left strap. |
| | ALTERNATIVE HORIZONTAL SUPPORT ASSEMBLY |
| 36. adjastable resistance ball joint assembly. | 50. support insert. |
| 360. ball. | 52. tilt and roll support ball upper housing |
| 361. connecting pin. | 54. tilt and roll horizontal shaft. |
| 362. ball housing upper part. | 56. tilt and roll support ball. |
| 363. ball housing lower part. | 58. connecting bolts. |
| 364. ball housing bolt. | 60. roll stopping pin. |
| 365. ball housing nut. | 62. tilt stopping pin. |

DETAILED DESCRIPTION OF THE INVENTION

In the following description similar features in the drawing were given similar numerals.

Referring to FIG. 1 there is illustrated a swimming exercise and training in accordance with the present invention.

The apparatus comprises a base means(11) disposed on a supporting surface, a telescopic vertical adjustable support means including a support sleeve(13) into which a support insert(15) is inserted in a manner to enable adjustment of the hight in relation to the base. A horizontal support sleeve(33) as in FIG. 2 connected to the support insert(15) by means of a pin(17) which is inserted into corresponding holes in the support insert(15) and the connecting half round tilt plate(21) in a manner to permit an up and down limited tilt of the horizontal support sleeve the limiting means being flexible such as rubber or spring this embodiment allows the user to simulate the dolphin like movement.

A horizontal roll shaft which has an aft section(23) a fore section(27) telescopically attached in a manner to permit length adjustment of the shaft, inserted into the horizontal support sleeve(33) in a manner to permit axial roll inside the horizontal support sleeve(33), a limiting means is attached to the horizontal roll shaft to absorb impact and limit the roll.

The tilt can be eliminated if so desired by inserting a tilt stopping pin(19) in a corresponding holes in the support insert(15) and connecting tilt half round plate(21).

The roll can be eliminated if so desired by inserting a roll stopping pin(25) in corresponding holes in the horizontal support sleeve(33) and the horizontal roll shaft (23), (27).

A waist support pad(35) attached to an attachment plate(29) which is attached to the aft section of the roll shaft(23) behind a chest support pad(37) which is attached to an attachment plate(31) which is attached to the roll shaft fore section(27).

An attachment bar(41) attached to the fore section of the chest support pad.

A head support (39) attached to the attachment bar(41) and capable of limited axial rotation.

An adjustable resistance ball joint assembly(36)attached to the right side of the attachment bar(41) and another one attached to the left side of the attachment bar(41).

Figure 3:
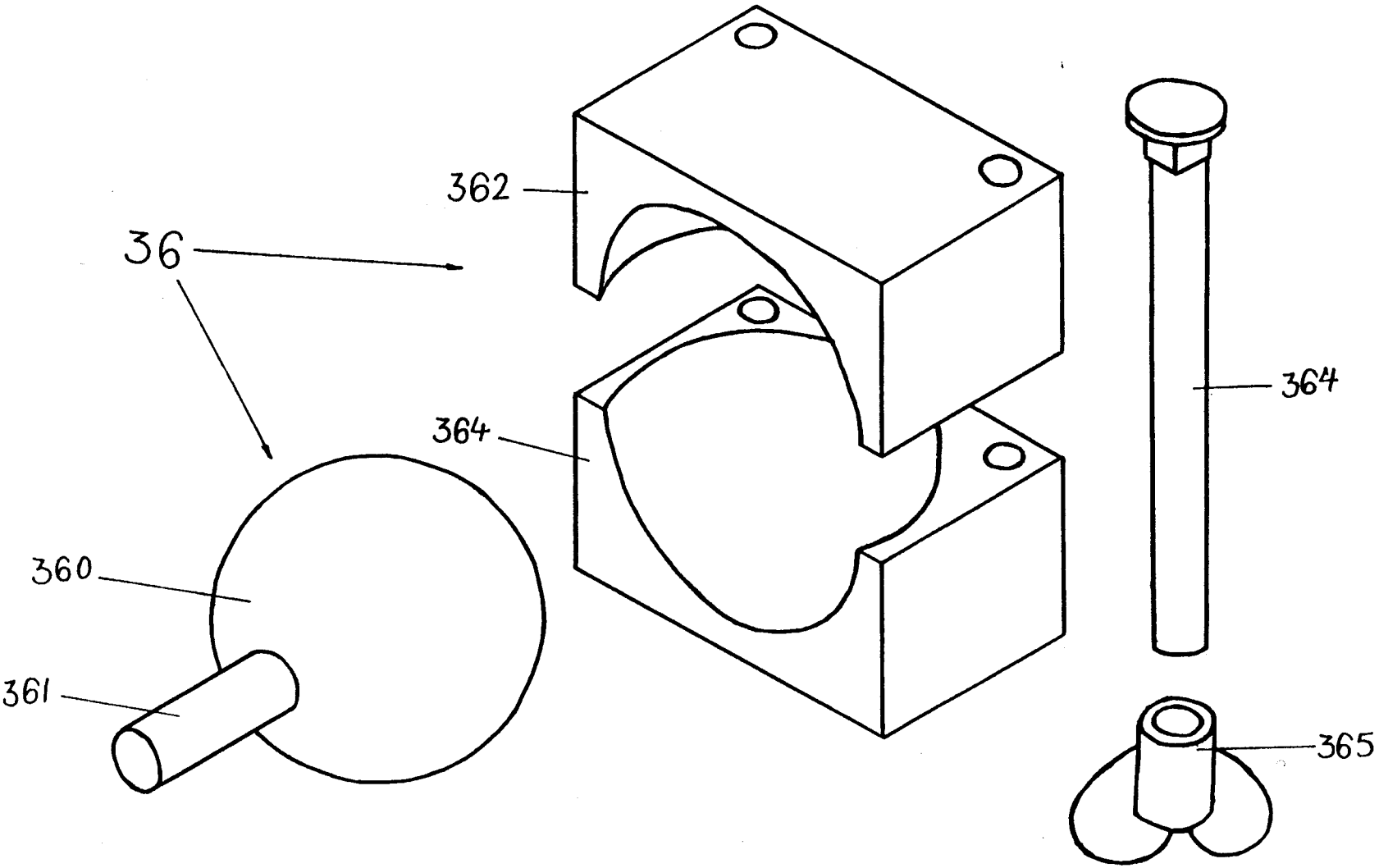
FIG. 3 is an exploded view of a resistance adjustable ball joint.

Referring to FIG. 3 the adjustable resistance ball joint assembly comprises a ball(360), a connecting pin(361), a ball housing upper part(362), a ball housing lower part(363), ball housing bolts(364), ball housing nuts(365), the interior of the ball housing may be lined with a friction inducing means such as used in automobile brakes, the resistance can be adjusted tightening the nuts(365).

A pair of arm lever assemblies are connected to the adjustable resistance ball joint assembly(36)by means of the connecting pin(361) to the right and left of the attachment bar(41), this embodiment permits the user to move his arms rotatably in several dimensions and have resistance throughout the whole movement.

Figure 4:
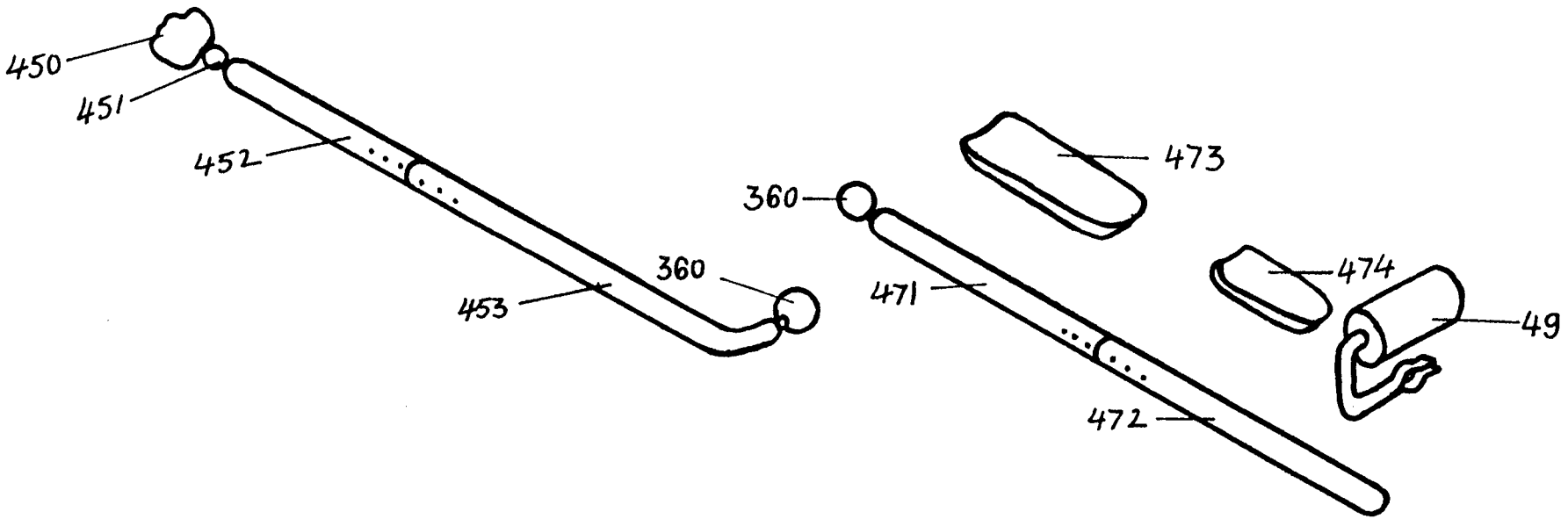
FIG. 4 is a view of the arm lever and an exploded view of leg lever.

Referring to FIG. 4 the arm lever assembly comprises a hand grip(450) attached to a flexible coupling, in this embodiment a ball joint(451) which is attached to the arm lever fore section(452) which is telescopically attached to the arm lever aft section(453) in a manner to permit the length adjustment of the arm lever assembly(45).

An attachment bar(43)attached to the aft section of the roll shaft(23) to which adjustable resistance ball joints are attached to the right side and the left side.

A pair of leg lever assemblies(47) are connected to the ball joint assemblies in a manner to permit the user to move his legs up and down in several dimensions in correspondence to the upper body roll.

Referring to FIG. 4 the leg lever assembly comprises a roll cushion(49) attached to the aft section of the leg lever assembly(472) in a spaced relationship to permit the users calf between the roll cushion(49) and the leg lever(47), an aft section(472) telescopically attached to the leg lever fore section(471) in a manner to permit the length adjustment of the leg lever assembly(47).

A thigh support pad(473)attached to the leg lever fore section

A calf support pad attached to the leg lever aft section.

Figure 2:
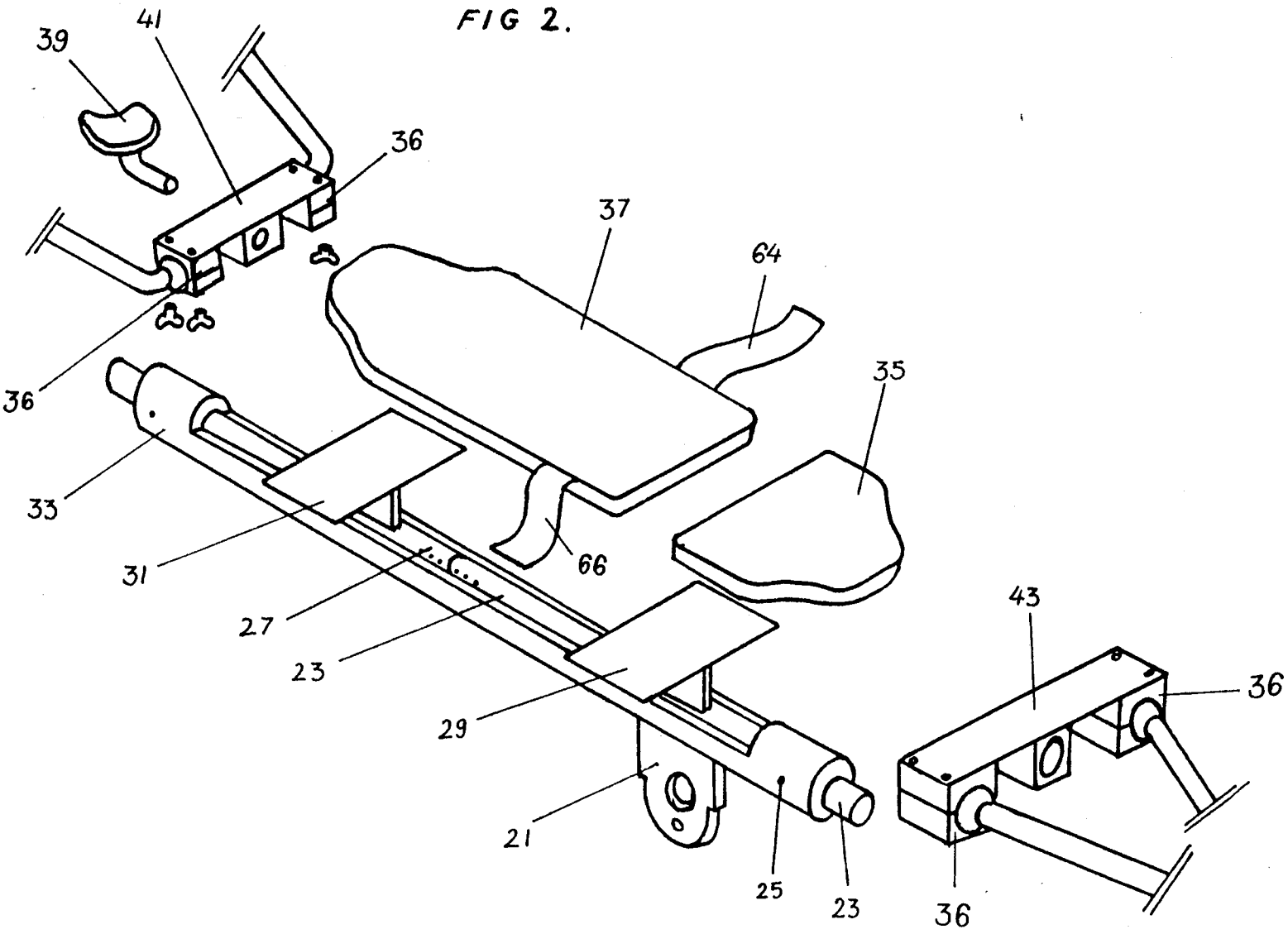
FIG. 2 is an exploded view of the upper section excluding the base frame.

Referring to FIGS. 1 and 2 a right strap(64) and a left strap(66) are provided to permit the user to secure his body to the apparatus.

Figure 5:
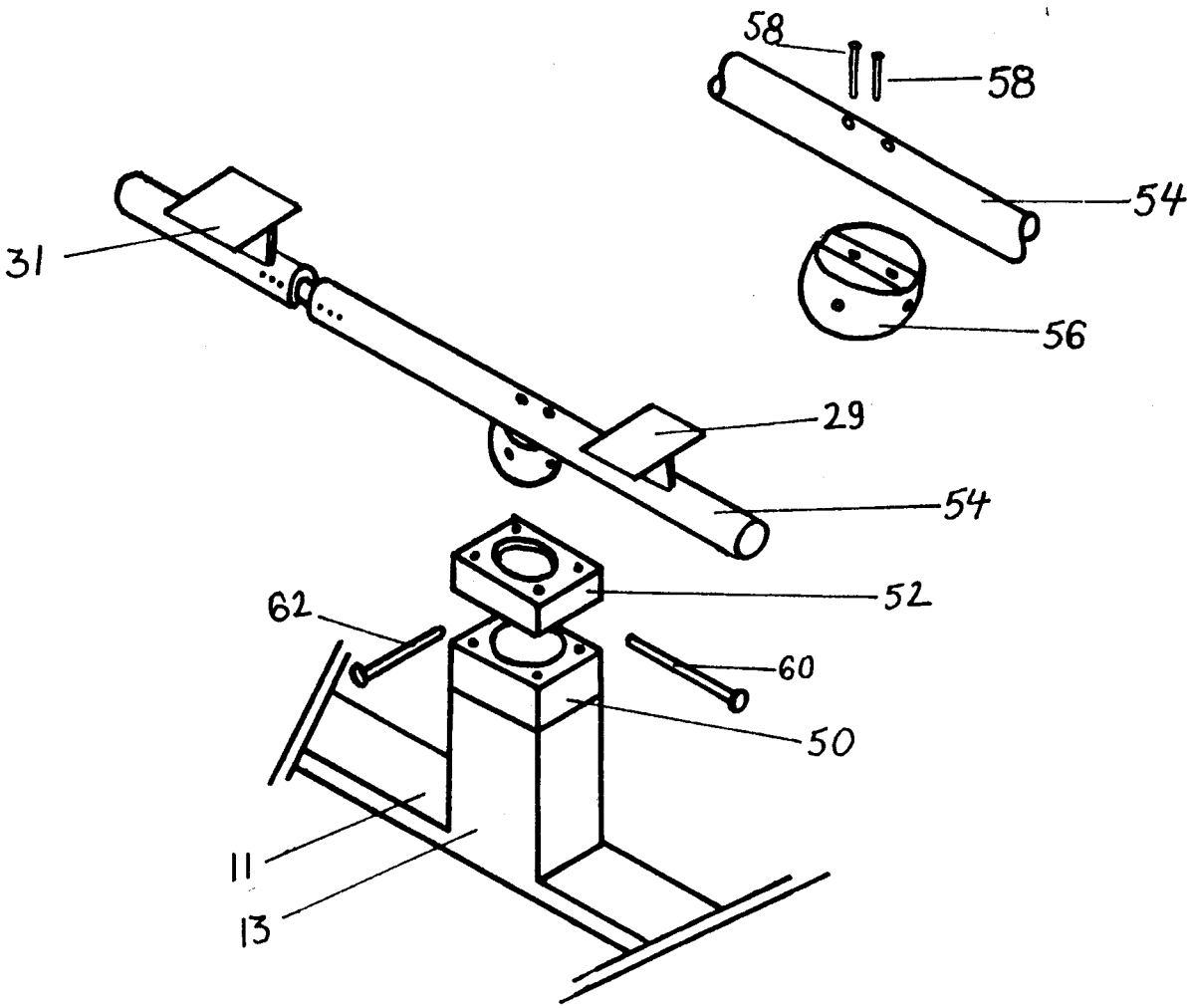
FIG. 5 is an exploded view of the support, tilt, and roll arrangement that is an alternative to the preferred arrangement.

Referring to FIG. 5 another embodiment of the tilt and roll mechanism is presented comprising a support insert(50) attached to a ball upper housing(52) which together enclose a tilt and roll support ball(56) which is attached to a horizontal shaft (54).

This embodiment permits tilt and roll in several dimensions.

The tilt movement can be eliminated if so desired by inserting pin(62) in corresponding holes in the upper housing(52) and in tilt and roll ball(56).

The roll movement can be eliminated if so desired by inserting pin (60) in corresponding holes in the upper housing(52) and in tilt and roll ball.

I claim:

1. A swimming exercise and training apparatus comprising:

a base member for supporting the apparatus on a supporting surface;

a horizontal support extending along a longitudinal axis, said horizontal support pivotally secured to said base member in a spaced relationship thereto for pivotal movement about a horizontal axis extending laterally of said longitudinal axis of said horizontal support;

a first support member for supporting the user's chest, said first support member having right and left lateral sides and first and second longitudinal ends and secured to said horizontal support for limited rotation about said longitudinal axis of said horizontal support;

an attachment bar attached to said first end of said first support member, said attachment bar having first and second ends and extending laterally of said horizontal support;

a second support member for supporting the user's waist, said second support member having first and second ends, said first end of said second support member secured to said horizontal support proximate said second end of said first support member for limited rotation about said longitudinal axis of said horizontal support;

a third support member for supporting the user's head, said third support member secured to said attachment bar proximate said first end of said first support member for limited rotation about said attachment bar;

a pair of arm movement members secured respectively to said first end and said second end of said attachment bar proximate respectively to said right side and left side of said first end of said first support member, each said arm movement member secured to said attachment bar for movement in a plurality of vertical planes such that each said arm movement member may move in an arc approximating the movement of the user's arm;

a pair of leg movement members secured to said horizontal support proximate said second end of said second support member, each said leg movement member secured to said horizontal support for movement in a plurality of vertical planes such that each said leg movement member may move in an arc approximating the movement of the user's leg; and adjustable resistance members attached to each said arm movement member and to each said leg movement member providing adjustable resistance to movement of each said arm movement member and to each said leg movement member.

2. The swimming exercise and training apparatus of claim 1, wherein said first support member includes straps for securing a user thereto.

3. The swimming exercise and training apparatus of claim 1, wherein each said leg movement member includes a roll cushion attached in spaced relation thereto such that the user's calf may be inserted between said leg movement member and said roll cushion.

4. The swimming exercise and training apparatus of claim 1, wherein said adjustable resistance members include a ball, a housing for said ball, a pin attached to said ball, and a member for adjusting the frictional engagement of said housing with said ball.

5. The swimming exercise and training apparatus of claim 1, wherein each said arm movement member includes a telescopic lever having a first end secured to said first support member and a second distal end, a hand grip, and a flexible coupling connecting said hand grip to said second distal end of said telescopic lever.

6. The swimming exercise and training apparatus of claim 1, further comprising a connecting rod secured to said horizontal support at said second end of said second support member, and wherein each said leg movement member includes a telescopic lever attached at one end to said connecting rod.

7. The swimming exercise and training apparatus of claim 1, wherein each said leg movement member includes a first section proximate said horizontal support and a second section distal from said horizontal support, a first support pad attached to said first section of said leg movement member for supporting the user's thigh and a second support pad attached to said second section of said leg movement member for supporting the user's calf.

8. The swimming exercise and training apparatus of claim 1, wherein said horizontal support includes:

a cylindrical sleeve;

a shaft having telescoping sections contained within said cylindrical sleeve for limited rotation of said shaft with respect to said sleeve, said telescoping sections being adjustable with respect to one another permitting adjustment of the length of said shaft;

a first flat plate attached to said shaft, said first support member being attached to said first flat plate;

a second flat plate attached to said shaft, said second support member being attached to said second flat plate; and a semi-circular plate attached to said cylindrical sleeve for pivotal securement of said horizontal support for pivotal securement of said horizontal support to said base member.

9. The swimming exercise and training apparatus of claim 8, wherein said base member includes a telescopic vertical column, said column being secured to said horizontal support through said semi-circular plate.

* * * * *